US006510689B2

(12) United States Patent
Budliger

(10) Patent No.: US 6,510,689 B2
(45) Date of Patent: Jan. 28, 2003

(54) METHOD AND DEVICE FOR TRANSMITTING MECHANICAL ENERGY BETWEEN A STIRLING MACHINE AND A GENERATOR OR AN ELECTRIC MOTOR

(76) Inventor: Jean-Pierre Budliger, Route de Loex 31, CH 1213 Onex (CH)

( * ) Notice: Subject to any disclaimer, the term of this patent is extended or adjusted under 35 U.S.C. 154(b) by 0 days.

(21) Appl. No.: 09/972,263

(22) Filed: Oct. 5, 2001

(65) Prior Publication Data

US 2002/0096884 A1 Jul. 25, 2002

Related U.S. Application Data

(63) Continuation of application No. PCT/CH00/00199, filed on Apr. 5, 2000.

(51) Int. Cl.[7] ..... F01B 29/10
(52) U.S. Cl. ..... 60/517; 60/520; 60/524
(58) Field of Search ..... 60/517, 524, 526, 60/520

(56) References Cited

U.S. PATENT DOCUMENTS 3,858,802 A * 1/1975 Stobart ..... 237/12.1
4,458,495 A * 7/1984 Beale ..... 60/520
4,717,405 A * 1/1988 Budliger ..... 60/517
5,174,116 A 12/1992 Ishikawa

FOREIGN PATENT DOCUMENTS

| | | |
|---|---|---|
| EP | 0 070 780 | 1/1983 |
| EP | 0 860 622 | 8/1983 |
| EP | 0 218 554 | 4/1987 |
| EP | 0 447 134 | 9/1991 |

* cited by examiner

*Primary Examiner*—Hoang Nguyen
(74) *Attorney, Agent, or Firm*—Henderson & Sturm LLP

(57) ABSTRACT

A method for transmitting mechanical energy between a transfer piston of a Stirling machine and a moveable member of a generator or of an electric motor. A subject of this invention is also a device for implementing this method. The replacing of the driving piston by a completely static pneumatic resonator makes it possible not only to considerably simplify the device, since this method makes it possible to dispense with the driving piston, but also to facilitate the servocontrol as will be explained subsequently. This signifies that not only does the invention make it possible to substantially simplify the device and to reduce the production costs thereof, but also that the reliability of the device is thereby increased. However, for such a device to have an economical benefit, not only must it be possible to produce it at a competitive price, but it must also be capable of operating for many years without requiring any servicing or adjustment.

17 Claims, 5 Drawing Sheets

METHOD AND DEVICE FOR TRANSMITTING MECHANICAL ENERGY BETWEEN A STIRLING MACHINE AND A GENERATOR OR AN ELECTRIC MOTOR

CROSS REFERENCE TO RELATED APPLICATIONS

This application is a Continuation application of PCT/CH00/00199 filed Apr. 5, 2000, which claimed priority of European Application No. 99810286.7 filed Apr. 7, 1999, entitled "Method and Device for Transmitting Mechanical Energy Between a Stirling Machine and a Generator or an Electric Motor" all of which are including in their entirety by reference made hereto.

BACKGROUND OF THE INVENTION

1. Field of the Invention

The present invention relates to a method for transmitting mechanical energy between a transfer piston of a Stirling machine and a moveable member of a generator or of an electric motor, the transfer piston being mounted in a cylinder, according to which a working gas is periodically displaced between an expansion chamber and a compression chamber with the aid of said transfer piston, said chambers being associated respectively with two working faces of said transfer piston, by making said gas pass through a hot, alternately cold exchanger linked to a heat source, a regenerator and a cooling exchanger linked to a heat sink, and an elastic restoring force is exerted on this transfer piston.

2. Description of the Related Art

Free-piston Stirling machines have long been regarded as an ideal solution for heat/force coupling units serving for the production of thermal and mechanical energy for homes. The possibility of increasing the degree of use of fossil fuel, the cleanliness of the external combustion process and the quiet operation of the device constitute the main arguments in favor of the application of this technology to homes. However, up to now the complexity and high cost of such units have prevented their use.

It has recently been proposed to associate a driving piston with a transfer piston of a Stirling machine and to fix the field magnets of an electric alternator to this driving piston so as to displace them relative to the windings of the armature of this alternator. This promising concept has the drawback however of requiring two coaxial pistons, moveable with respect to one another, which must be guided with high accuracy. Specifically, the rod of the transfer piston is mounted slideably in a gas-filled closed volume of the driving piston, which pneumatically couples these two pistons. This system also requires servocontrol in such a way as to adjust the phase shift between these pistons. Such a system is developed by the American firm Sunpower Inc., Athens, Ohio, and is in particular the subject of an article entitled "Development of a 3 kW free-piston Stirling engine with the displacer gas-spring partially sprung to the power piston", G. Chen and J. McEntee, Proceedings of the 26th Intersociety Energy Conversion Engineering Conference, vol. 5, p. 233–238. Strong elastic coupling between the two pistons indicates that a substantial fraction of the driving energy induced is produced by the forces of the gas acting on the transfer piston and transferred by the elastic linkage to the driving piston. The authors of the article affirm that ⅔ of the total energy is produced by the transfer piston of the Stirling engine. In this engine, this piston serves therefore not only to transfer the gas between the hot and cold volumes situated at the two ends of the cylinder in which this piston is displaced, but also to produce a part of the driving energy.

Certainly, one could thereupon legitimately ask whether it would not be possible to produce all of the driving energy with the aid of the transfer piston and to associate the moveable part of the electric generator with the latter. Such an assumption by itself would not however solve the abovementioned problems. Specifically, since the phase shift required between the two coaxial pistons is still necessary to allow the production of energy and its transfer, the problems of guidance and servocontrol would remain unchanged.

BRIEF SUMMARY OF THE INVENTION

The aim of the present invention is to remedy, at least in part, the abovementioned drawbacks.

Accordingly, a subject of this invention is firstly a method for transmitting mechanical energy between a transfer piston of a Stirling machine and a moveable member of a generator or of an electric motor. A subject of this invention is also a device for implementing this method.

The replacing of the driving piston by a completely static pneumatic resonator makes it possible not only to considerably simplify the device, since this method makes it possible to dispense with the driving piston, but also to facilitate the servocontrol as will be explained subsequently. This signifies that not only does the invention make it possible to substantially simplify the device and to reduce the production costs thereof, but also that the reliability of the device is thereby increased. However, for such a device to have an economical benefit, not only must it be possible to produce it at a competitive price, but it must also be capable of operating for many years without requiring any servicing or adjustment.

BRIEF DESCRIPTION OF THE DRAWINGS

Other features and advantages of the method and of the device which are the subjects of the invention will become apparent on reading the description which follows, as well as the appended drawing, which illustrates, schematically and by way of example, two embodiments and alternative variants of this device.

DETAILED DESCRIPTION OF THE INVENTION

Figure 1:
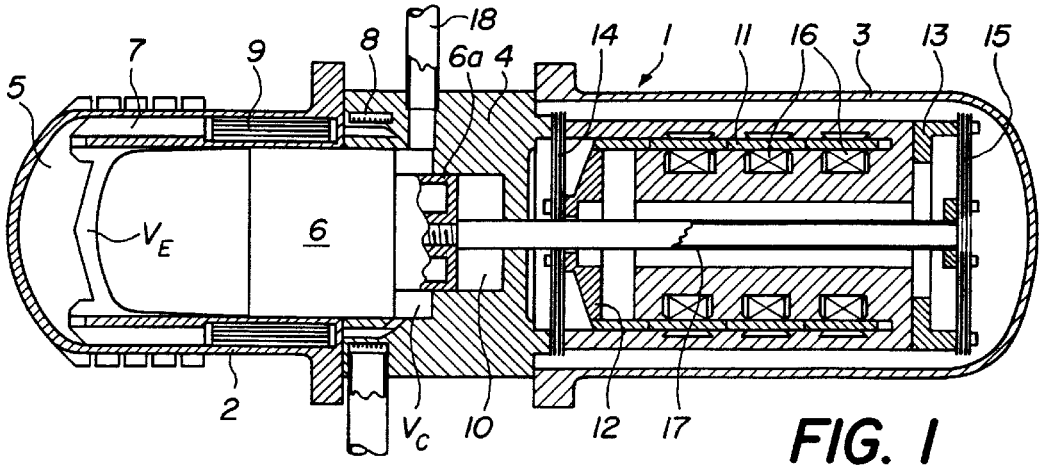
FIG. 1 is a diametral sectional view of this embodiment.

The device illustrated by FIG. 1 comprises an elongate casing 1 formed with two cylindrical compartments 2, 3, assembled to an intermediate element 4, playing the role of frame. The cylindrical compartment 2 comprises a cylindrical housing 5, constituting a working volume of a Stirling engine, in which a transfer piston made in two parts 6, 6*a* is mounted, free to displace on the longitudinal axis of the cylindrical housing 5. At one end, the volume situated between the part 6 of the transfer piston 6, 6*a* and the outer end of the housing 5 is that which is in contact with a hot exchanger 7 linked to a hot source (not represented) and constitutes the hot chamber or expansion volume $V_E$ of the Stirling engine, while at the other end of this cylindrical housing 5 there is a volume in contact with a cold exchanger 8 linked to a cold source (not represented), which constitutes the cold chamber or compression volume $V_c$ of the Stirling engine. A regenerator 9 is disposed between the hot 7 and cold 8 exchangers.

The transfer piston 6, 6*a* part 6*a* adjacent to the compression chamber $V_c$ is engaged in a closed volume 10 filled with working gas, which constitutes a means of elastic restoring of the transfer piston 6, 6*a*.

The cylindrical compartment 3 encloses a volume in which a moveable element of an electric generator, here the field 11 consisting of a cylindrical element carrying permanent magnets, is secured to the periphery of an annular member 12, whose internal edge is secured to an elastic suspension member 14, consisting of annular flat springs, whose peripheral edges are fixed to the frame 4 and whose inner edges are secured to a rod 17 one end of which is fixed to the part 6*a* of the transfer piston 6, 6*a*. The inner edge of a second elastic suspension member 15 similar to the member 14, is fixed to the other end of the rod 17, while its periphery is fixed to a support 13 secured to the frame 4. The armature of the generator is formed by windings 16.

The part 6*a* of the transfer piston 6, 6*a* and the rod 17 pass through the bottom of the closed volume 10 formed in the intermediate element 4 with a clearance of between 30 and 50 $\mu$m. Such a clearance is perfectly acceptable both from the point of view of the manufacturing tolerances and the influence of leakages of the working gas on the energy efficiency and on the restoring force of the compressed gas in the closed volume 10.

A tubular resonator 18, of which only the end secured to the cylindrical compartment 2 is represented in FIG. 1, communicates with the compression volume or cold chamber $V_C$ of the Stirling engine. The role of this resonator is to replace the second piston which, according to the method which is the subject of the invention, no longer serves to produce energy, all the energy being produced by the transfer piston 6, 6*a* as will be explained hereinbelow, but serves to amplify the pressure wave and to ensure an appropriate phase shift between the displacement of the transfer piston 6, 6*a* and the variations in pressure p in the working volume.

Figure 3:
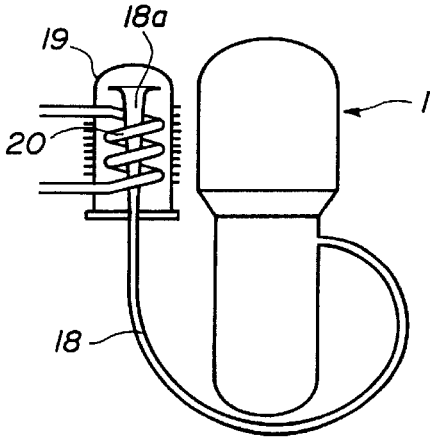
FIG. 3 is a view in elevation of the device according to FIGS. 1 or 2.

As illustrated by FIG. 3, the other end of this tubular resonator 18 advantageously terminates inside a Helmholtz volume 19. In this case, preferably, the part of this resonator which is located in the Helmholtz volume terminates in a bell mouth 18*a*.

The transfer piston 6, 6*a* then plays the dual role of transferring the working gas between the expansion chamber $V_E$ and the compression chamber $V_c$ and of producing all the driving energy transmitted to the field 11, as long as certain conditions, of which we shall now speak, are fulfilled.

To achieve this objective, it is necessary to determine the ratio between the surface area $a_C$, delimiting the compression chamber of the transfer piston 6, 6*a* and that $a_E$ of the same piston, delimiting the expansion chamber.

Analysis of the isothermal cycle shows that the pressure of the working gas in the working volume becomes independent of the position of the transfer piston 6, 6*a* if:

$$\frac{a_C}{a_E} = \frac{T_C}{T_H}$$

Example

Temperature $T_H$ of the hot volume $V_E$, $T_H$=923° K.=650° C.

Temperature $T_c$ of the cold volume $V_C$, $T_C$=323° K.=50° C.

$$a_C/a_E \geqq 0.35$$

The operation of the engine is possible only if the surface area ratio $a_C/a_E$ is greater than this limit, that is to say the displacement of the transfer piston 6, 6*a* must induce a pressure component $p_X$ (FIG. 4) which must be opposed to the displacement X of this piston 6, 6*a*. The displacement of the transfer piston 6, 6*a* is positive if the latter moves toward the volume $V_E$. The variation in the amount WG of working gas in the working volume of the Stirling engine gives rise to a variation in pressure $p_W$, which is in phase with the variation in the amount WG of working gas. The variation in the pressure p in the working volume of the Stirling engine corresponds to the vector sum of the two partial pressures $p_X$ and $P_W$.

Figure 4:
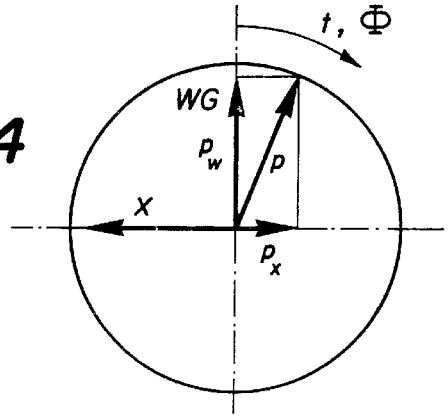
FIG. 4 is a vector diagram.
Figure 5:
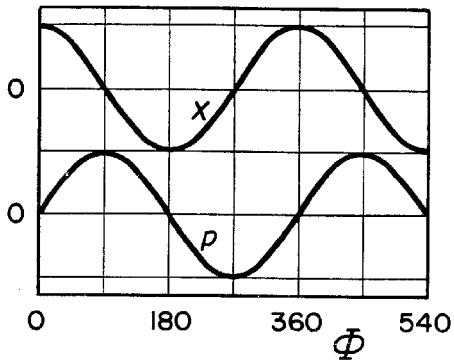
FIGS. 5 and 6 are explanatory diagrams relating to the method.

FIG. 5 shows the variation in the position X of the transfer piston 6, 6*a* and the variation in the pressure as a function of time (or the angle Φ). This representation corresponds schematically to that of FIG. 4. As the pressure decreases, the working gas is located to a large extent in the hot chamber or expansion chamber; as it increases, the working gas is essentially located in the cold chamber or compression chamber. To produce energy, the displacement X of the piston 6 must precede the variation in pressure p.

Figure 6:
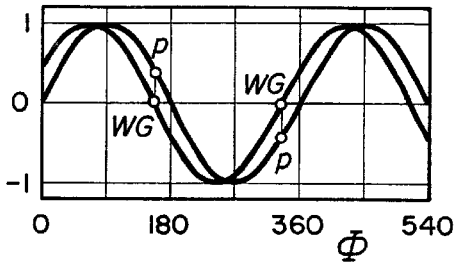

FIG. 6 represents the variation in the amount WG of working gas in the Stirling working volume and the pressure p in this volume. When the working gas flows toward the tubular resonator 18, the amount WG of gas decreases, the pressure is greater than during its return where the amount WG of gas increases. There is therefore transport of energy from the Stirling volume to the tube, which compensates for the frictional losses in this tubular resonator 18.

In order for p to lag behind the variation in the amount WG of working gas, FIG. 4 shows that $p_X$ must be opposite to X. If $p_X$ becomes zero, or oriented in the direction of X, no energy is transmitted to the tubular resonator 18 to compensate for the frictional losses. Consequently, the pressure wave cannot be maintained and the machine ceases to operate.

Following an optimization study performed with the aid of a computer program specially adapted for the calculation of Stirling cycles according to the present invention, the results have shown that for the Stirling generators, the ratio of the sections $a_C/a_E$ must lie between 0.4 and 0.6, preferably between 0.45 and 0.55.

Figure 7:
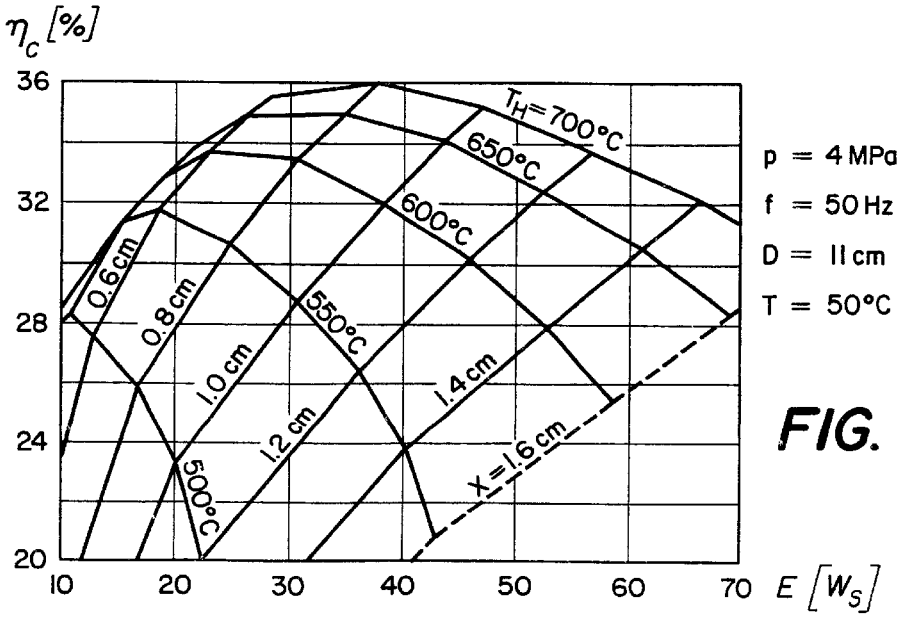
FIG. 7 is a diagram relating to the efficiency of the cycle relative to the work per cycle.

FIG. 7 gives an example of the efficiency of the cycle $\eta_C$ calculated as a function of the work provided per cycle E, with the wall temperature $T_H$ of the expansion chamber $V_E$ and the sweep X of the transfer piston 6, 6*a* as parameter. The temperature of the cold exchanger T, close to the temperature $T_C$ is around 50° C. The net efficiency of the generator can be obtained by multiplying the efficiency of the cycle by the efficiency of the heating means and the efficiency of the alternator.

This diagram shows that in a relatively wide range of sweeps of the transfer piston, good efficiencies can be obtained, the highest values being attained at partial load. The efficiencies are slightly lower than those of the above-mentioned state of the art device, but this very slight reduction is amply compensated for by the simplification afforded to the device.

The Stirling engine ought always to operate at expansion chamber temperatures of between 600° and 700° C. In this range, the temperature $T_H$ of the expansion chamber $V_E$ chiefly influences the power, and to a lesser extent the efficiency. However, by lowering the temperature to 400–500° C., the efficiency and the power decrease greatly, essentially because, under these conditions, the variation in pressure $p_X$ induced by the motion of the piston becomes small and ultimately disappears completely.

The lateral rigidity of the mechanical suspension of the transfer piston 6, 6*a* is ensured by flat springs 14, 15 of the type of those described in "Recent developments in cryocoolers", Ray Radebaugh, 19th International Congress of Refrigeration 1995 Proceedings, Volume IIIb, allows [sic] it to oscillate perfectly according to the longitudinal axis of the cylindrical housing 5, so that it is not necessary to use pneumatic bearings to center it. During initial assembly, the transfer piston 6, 6*a* can be centered with high accuracy. By reason of the pneumatic suspension of this transfer piston and consequently of the weak forces required for the elastic suspension elements consisting of the annular flat springs 14 and 15, it is possible to increase the sweep of the transfer piston 6, 6*a* from 25% to 50% relative to the device described in "Free-piston Stirling design features", Neill W. Lane et al., 8th International Stirling Engine Conference and Exhibition, May 27–30, 1997, Ancona. This increase in sweep leading to an increase in the linear velocities, makes it possible to reduce the dimensions of the alternator. Under unchanged operating conditions, similar amounts of energy can be attained.

The use of a single moving piston simplifies initial adjustment, startup and power control significantly relative to the conventional free-piston Stirling systems. The rigidity of the suspension of the transfer piston 6, 6*a* and consequently the phase angle can be adjusted by altering the pressure of the working gas in the working volume of the Stirling engine. The natural frequency of the tubular resonator 18 can be adjusted by varying the composition of the working gas, that is to say its molecular mass.

The engine is then started up by firstly bringing the temperature of the working gas in the expansion chamber $V_E$ to a value $T_H$ at which the pressure of the working gas becomes independent of the position of the transfer piston. The load of the Stirling engine is thus reduced to a minimum (losses due to internal friction of the engine and to the periodic flow through the exchangers and the regenerator). After startup, the temperature $T_H$ will be adjusted to the optimal working temperature.

The control of the power is performed very easily. The sweep of the transfer piston 6, 6*a* and consequently the power of the Stirling engine are altered by adjusting the braking force exerted by the electric generator to a specified value. For given temperatures of the gas $T_H$, $T_C$ in the expansion chamber, respectively compression chamber, the output power varies proportionally to the sweep of the transfer piston 6, 6*a*. The heating power of the burner (not represented) intended for heating the working gas of the expansion chamber $V_E$ is adjusted continuously so as to maintain the desired temperature $T_H$ in this expansion chamber $V_E$. Under normal conditions, the sweep of the transfer piston can therefore be controlled accurately. It is not therefore necessary to provide any additional dead volume in order to avoid shocks should the sweep of the transfer piston be accidentally exceeded. It is only necessary to prevent the transfer piston from exceeding a maximum sweep should there be a fault in the electrical network with which the electric generator is associated.

Any nonlinearity of the rigidity of the suspension of the transfer piston 6, 6*a*, has a marginal effect on its phase, given that it is coupled to a load and behaves like a strongly damped oscillator. Once the entire device has been sealed, the natural frequency of the tubular resonator 18 depends only on the mean temperature of the working gas located therein. This temperature can be accurately set to the desired value by means of an additional heat exchanger 20 disposed in the Helmholtz volume 19 and by controlling the thermal energy drawn off. This makes it possible to adjust the phase angle of the resonator with respect to the other variables of the system. Drawing off heat from the tubular resonator 18 makes it possible to decrease the cooling of the working gas situated in the compression chamber $V_C$, this making it possible to simplify the cold exchanger of the Stirling engine. Its dead volume and/or its pneumatic frictional losses can be reduced, affording an additional advantage to the device which is a subject of the present invention.

The pressure of the working gas in the Stirling volume varies cyclically as a function of the oscillation of the pressure wave in the tubular resonator 18. By appropriately varying the section of the tube, as will be explained hereinbelow, it is possible to obtain almost perfectly sinusoidal pressure variations. The energy dissipation is then due exclusively to the frictional losses of the fluid and remain moderate, at least for the pressure variations considered in this application. The parameters of the tubular resonator 18, an example of which follows, must be tailored to those of the Stirling process so as to guarantee that these components interact suitably, that is to say that the wave is driven by the Stirling cycle and that the resulting pressure variations maintain the periodicity of the Stirling cycle.

By way of example, the tubular resonator 18 can have a total length, including the Helmholtz volume 19, of around 1.6 m and a temperature T of 40° C. The mean pressure $p_O$, of the gas is D4 MPa and the resonant frequency of this resonator is 50 Hz. To limit the length of the tube, a working gas whose molecular mass is higher than that of helium will advantageously be used, such as a mixture of helium and of argon or of carbon dioxide with a molecular mass M of the gas of 14 kg/kmol. The minimum section $S_{min}$, of the tubular resonator 18 is, in this example, 4.75 $cm^2$. The working gas volume $V_S$ of the Stirling engine 2 is 1000 $cm^3$, while that of the Helmholtz volume 19 is 6000 $cm^3$.

Advantageously, the tubular resonator may be extended inside the Helmholtz volume 19. Given that this portion of the tube is exposed only to limited pressure differences, its wall may be thin and may thus easily be made conical 18*a* preventing the formation of steep-fronted pressure waves.

Figure 8:
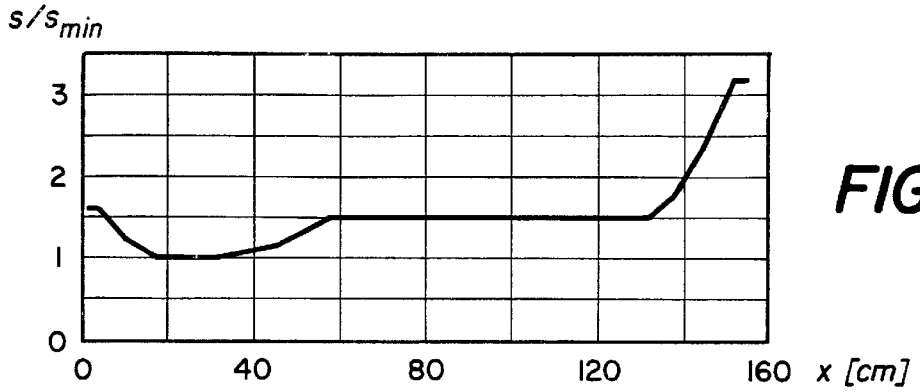
FIGS. 8 to 10 are diagrams relating to the dimensioning and to the behavior of the resonator.

An exemplary distribution of the section along the tube 18 of the resonator is represented in the diagram of FIG. 8. The left end of the diagram corresponds to the end of the tube 18 communicating with the Stirling compartment 2, while the right end corresponds to that which communicates with the Helmholtz volume 19.

Figure 9:
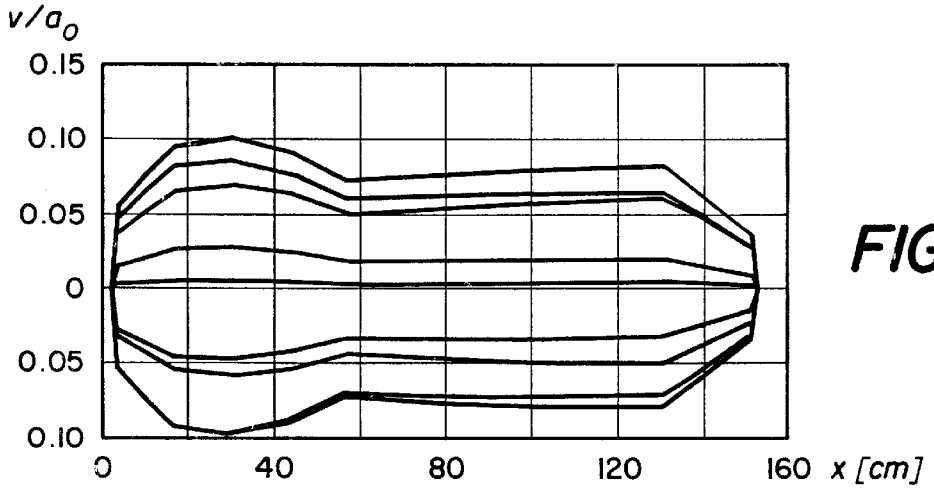
Figure 10:
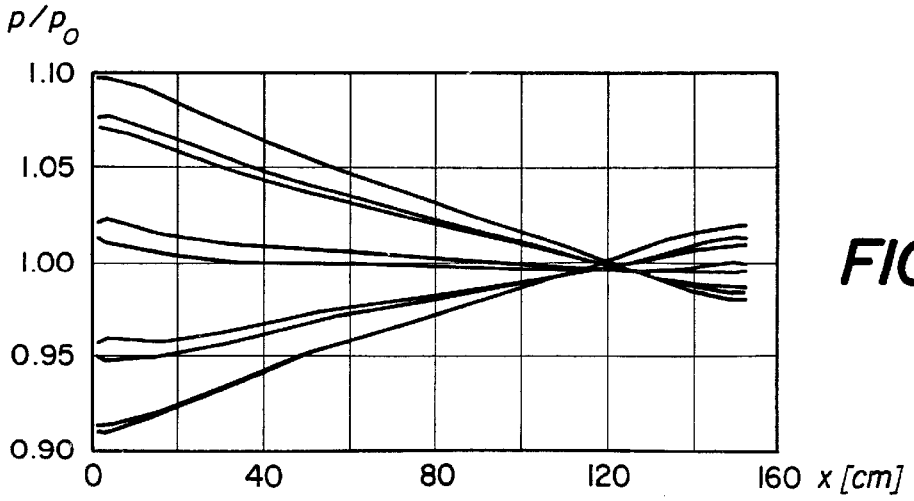

The diagram of FIG. 9 represents nine values at regular intervals of the speed of flow of the working gas in the tube 18, relative to the speed of sound (hence the Mach number) as a function of the position in the tube 18 during a cycle, while the diagram of FIG. 10 shows the distribution of the working gas pressure relative to the mean pressure during the same cycle.

The pressure diagram clearly shows that with appropriate dimensioning of the tube, no shock is produced at the resonant conditions of the tube 18. The pressure in the Stirling volume 2 varies sinusoidally. The pressure and the speed are orthogonal functions, that is to say if the pressure takes an extreme value, the speed of the working gas is zero and vice versa.

The calculated quality factor of the tube 18 lies between 25 and 40 for a pressure ratio in the Stirling volume $\pi_C = p_{max}/p_{min} = 1.1$, respectively between 15 and 25 for $\pi_C = 1.2$. The indicated span takes account of the fact that, on the one hand, the coefficient of friction of the working gas in the unsteady regime may differ from that of a steady state regime, and on the other hand that the roughness of the tubes is known only approximately.

In the case of the low-power, typically of the order of 2 kW to 5 kW, Stirling engine studied in this example, the displaced volumes of working gas are of the order of about 100 $cm^3$. The cylindrical parts of the tube typically have diameters of 2.5 to 4 cm. It may easily be curved or wound in such a way that the entire device occupies as reduced a volume as possible. By way of example the device illustrated by FIG. 3 may have a height of 90 cm, a width of 60 cm and a depth of 40 cm.

Figure 2:
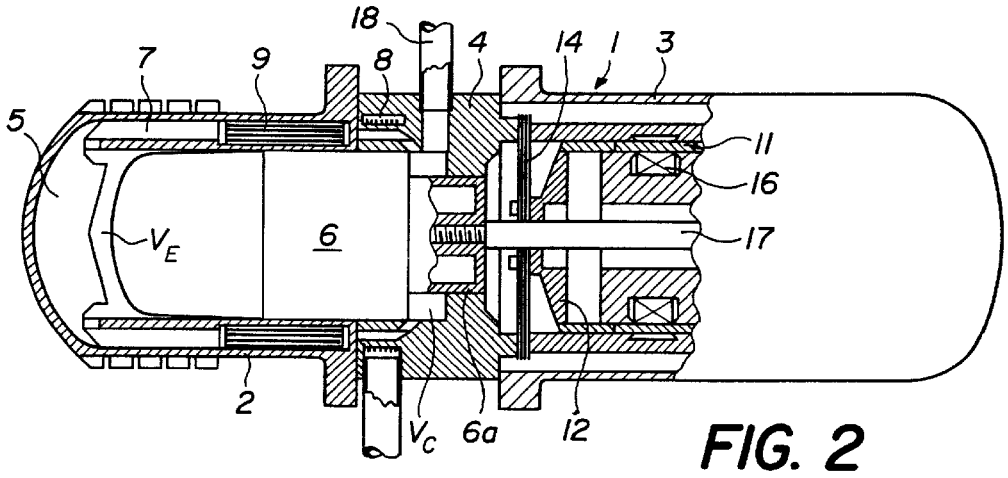
FIG. 2 is a view of a variant of FIG. 1.

The variant illustrated by FIG. 2 differs from the embodiment of FIG. 1 only through the fact that the member for the elastic restoring of the transfer piston 6, 6*a* no longer consists of the closed volume 10, but directly of the cylindrical compartment 3 enclosing the alternator. Specifically, this compartment is also a closed volume and can therefore also serve as elastic restoring member and thus replace the volume 10 of the embodiment of FIG. 1.

Up to now we have described just one embodiment in which the mechanical energy produced is transmitted to a reciprocating-motion member such as that of the free transfer piston 6, 6*a* of the Stirling engine. As a variant, it would also be possible to transform this reciprocating motion into a rotary motion as is well known in the case of internal combustion engines or steam engines.

Figure 11:
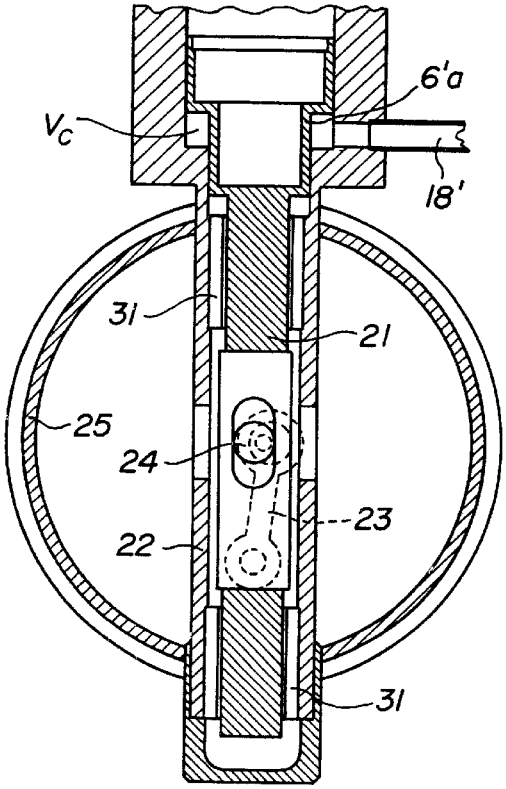
FIG. 11 is a partially sectioned view in elevation of the second embodiment.

Such a variant is illustrated by FIG. 11 in which are again depicted the end of the free transfer piston 6*a*' and that of the resonance tube 18' communicating with the cold chamber or compression volume $V_C$. A rod 21 is mounted slideably in a cylindrical guidance 22 by linear roller bearings 31. A connecting-rod 23 is articulated by one end to the rod 21 and by its other end to a crankshaft 24 secured to the axle of a rotary electric generator for example, mounted in an enclosure 25.

In a variant (not represented) of FIGS. 1 to 3 in particular, the tubular resonator 18 can consist of two identical tubular elements disposed in diametral opposition with respect to said transfer piston 6, 6*a* in such a way as to balance the lateral forces exerted on this transfer piston.

Figure 12:
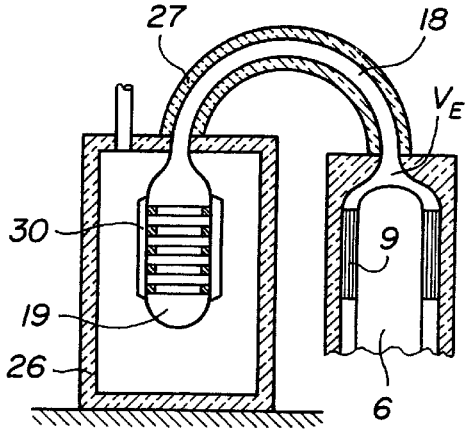
FIGS. 12 and 13 partially illustrate two variants for the heating of a Stirling engine.

As a variant, the tubular resonator 18 can be linked to the expansion volume $V_E$ or hot compartment of the Stirling engine, on condition that the whole of this tube is kept hot and does not constitute a heat sink. FIG. 12 illustrates a variant in which the Helmholtz volume 19 is placed in a heating enclosure 26, heated by gaseous, liquid or solid fuels, while the tube 18 is surrounded by thermal insulation 27. The temperature of the working gas contained in the tubular resonator 18 can thus be increased above the temperature $T_H$ of this gas in the expansion volume $V_E$. The tubular resonator 18, 19 can then be substituted in part or in full for the hot exchanger 7 of the Stirling engine. This therefore results in the partial or total saving of a complicated and expensive exchanger which is difficult to optimize (sufficient area of exchange with a reduced dead volume and low head losses). The tubular resonator 18, 19 exhibits a considerable exchange area and by virtue of the periodic flow set up in it, the internal transfer of heat is favorable. By reason of the standing wave regime set up in this resonator, its internal volume is not part of the dead volume of the Stirling engine.

The principle of operation of the Stirling cycle remains the same as that explained with the aid of FIGS. 4 to 6.

To favor the exchange of heat it is possible to increase the exchange area with the aid of fins 30 inside and/or outside the Helmholtz volume 19. Given that the diameter of the tube 18 is already of the order of two to four times greater than that of the heat exchanger 7 and that the diameter of the Helmholtz volume is again itself two to four times greater than that of the tube 18, the gap between the fins may be substantially increased. Consequently, such an exchanger is much less sensitive to fouling by soot or other combustion residues than conventional Stirling exchangers of small size. If necessary, it may easily be cleaned and is therefore especially well suited to systems operating with solid fuels or biomass.

Figure 13:
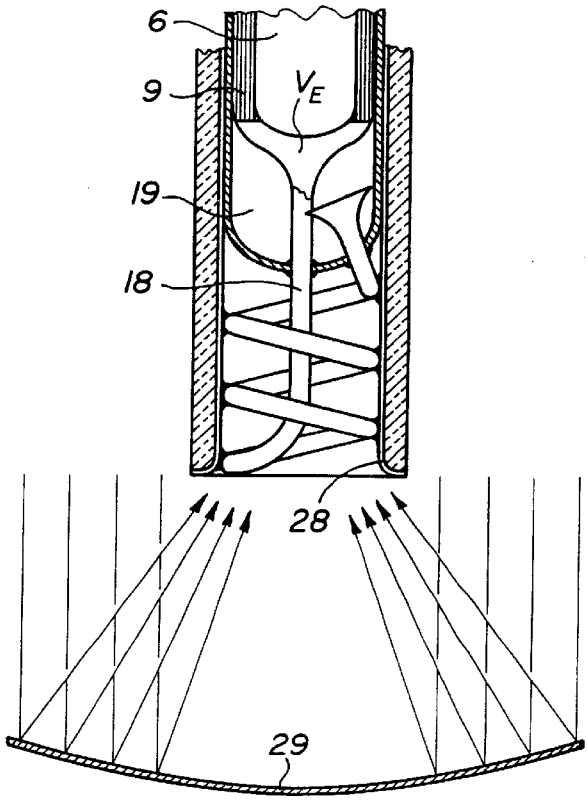

The variant illustrated by FIG. 13 shows a configuration in which the tubular resonator 18 is integrated into a high-temperature solar collector. Accordingly, the tube 18 of the resonator is made in the shape of a helix, placed inside a cylindrical or conical cavity 28. An end of this tubular resonator 18 opens into a Helmholtz volume 19, while the other end communicates with the expansion volume $V_E$ of the Stirling engine, whose transfer piston 6 and regenerator 9 have been represented. A parabolic mirror 29 disposed under the opening of the cavity 28 concentrates the solar radiation inside the cavity.

One of the advantages of this solution lies in the fact that such a collector is relatively insensitive to the exact distribution of the incident solar radiation, given that the periodic motion of the working gas in the tube 18 of the resonator ensures a uniform distribution of the temperature therein. Another advantage results from the fact that upon the appearance of the sun, when a temperature level $T_H$, of the working gas in the expansion chamber $V_E$ is obtained, the Stirling engine starts easily; the risk of instantaneous overheating of the collector is thus decreased.

Another variant (FIG. 14) very schematically illustrates the combination of four Stirling engines, of which it has been shown that the respective compression volumes $V_{CA}$, $V_{CB}$, $V_{CC}$, $V_{CD}$, alternatively the respective expansion volumes $V_{EA}$, $V_{EB}$, $V_{EC}$, $V_{ED}$, linked by four tubular resonators, of symmetric shapes $T_1$, $T_2$, $T_3$ and $T_4$ [sic]. The assembly forms a closed loop, each volume V being linked to two other neighboring volumes, the whole forming a square whose resonance tubes $T_1$ to $T_4$ constitute the sides, the volumes $V_{CA}$ to $V_{CD}$, alternatively $V_{EA}$ to $V_{ED}$ being disposed at the corners. This configuration makes it possible to increase the thermal power by ganging the machines according to a modular design.

When two Stirling engines are coupled by way of a tubular resonator in a symmetric configuration, they work in phase opposition. When four Stirling engines are disposed at the vertices of a square as in FIG. 14, the engines which are on the same diagonal are in phase and are 180° out of phase with respect to the other two engines disposed on the other diagonal. The forces transmitted to the exterior by this assembly are fully compensated for, thereby making it possible to reduce the vibrations transmitted to the exterior.

Figure 15:
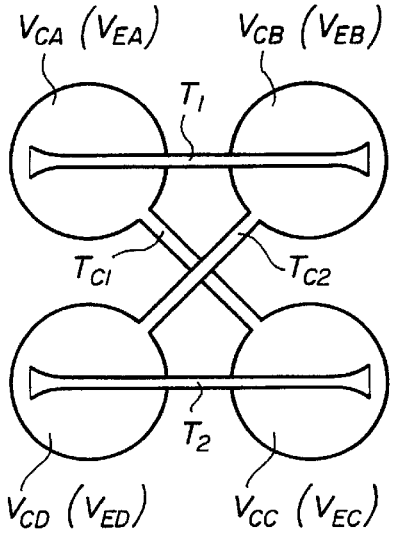

The variant of FIG. 15 shows simply two pairs of Stirling engines whose compression volumes $V_{CA}$, $V_{CB}$, respectively $V_{cc}$, $V_{CD}$, alternatively whose expansion volumes $V_{EA}$, $V_{EB}$, respectively $V_{EC}$, $V_{ED}$, are linked by two tubular resonators $T_1$, respectively $T_2$, while the compression volumes $V_{CA}$ and $V_{CC}$ on the one hand, and the compression volumes $V_{CB}$ and $V_{CD}$ on the other hand, alternatively the expansion volumes $V_{EA}$ and $V_{EC}$ on the one hand and the expansion volumes $V_{EB}$ and $V_{ED}$, on the other hand, are linked to one another by linking tubes $TC_1$ and $TC_2$ whose role is to ensure that the pressures of the compression, alternatively expansion, volumes thus linked are the same, given that the engines disposed on the diagonals are in phase.

Figure 16:
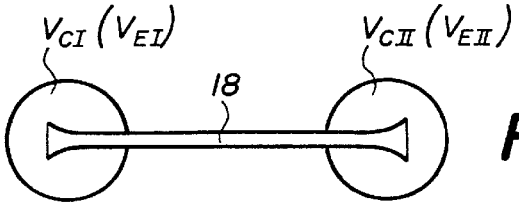

FIG. 16 shows two Stirling engines illustrated solely by their compression volumes $V_{CI}$, $V_{CII}$, alternatively their expansion volumes $V_{EI}$, $V_{EII}$ linked by a tubular resonator 18.

Figure 14:
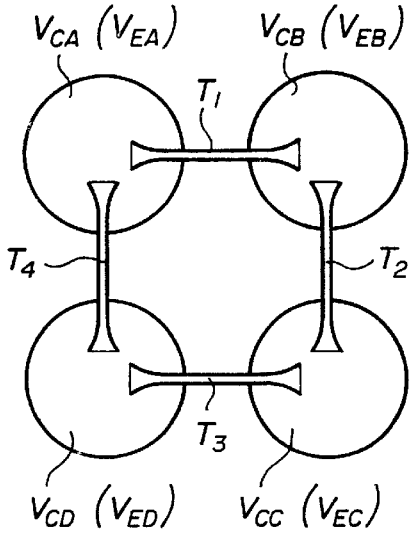
FIGS. 14 to 16 illustrate three variants in which Stirling engines are linked by resonance tubes.
Figure 17:
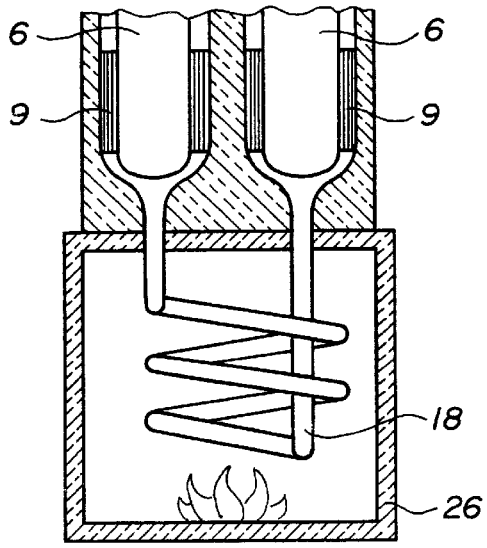
FIG. 17 illustrates a mode of heating applicable to the variants of FIGS. 14 to 16.

FIG. 17 shows the heating of a tubular resonator 18 linking two Stirling engines, as illustrated by FIGS. 14 to 16, which is disposed in a heating enclosure 26. The respective ends of the tube 18 of this resonator communicate with the expansion volumes $V_{EI}$, $V_{EII}$ of two Stirling engines. Thus the tube 18 of the resonator common to these two engines also constitutes a heating element common to these two engines. It would also be conceivable to use several resonance tubes 18 in parallel so as to increase the exchange area and improve the heat transfer.

All the foregoing examples show a Stirling machine operating as an engine for driving an electric generator. Now, it is well known that Stirling machines can also operate in reverse mode: instead of heating the working gas circulating through the expansion chamber so as to produce mechanical energy, it is also possible, by driving the transfer piston mechanically, to produce cold by expansion of the gas in this expansion chamber.

Given that in this mode of operation the resonance tube used is entirely passive, the latter can operate only if it is fed with energy by the Stirling cycle. This implies that for a cryogenic machine, the section $a_E$ of the transfer piston 6, 6*a* delimiting the expansion volume $V_E$ should be smaller than the section ac of this transfer piston 6, 6*a* delimiting the compression volume $V_C$. The ratio of these two sections $a_E/a_C$ determines the lowest temperature level which can theoretically be attained.

What is claimed is:

1. A method for transmitting mechanical energy between a transfer piston of a Stirling machine and a moveable member of a generator or of an electric motor, the transfer piston being mounted in a cylinder, according to which a working gas is periodically displaced between an expansion chamber ($V_E$) and a compression chamber ($V_c$) constituting the working volume of said Stirling machine, with the aid of said transfer piston, said chambers being associated respectively with two working faces of said transfer piston, by making said gas pass through a hot, alternatively cold exchanger, linked to a heat source, a regenerator and a cooling exchanger linked to a heat sink and an elastic restoring force is exerted on this transfer piston, said piston constituting the only moveable item of said Stirling machine is disposed in said cylinder, one of said compression ($V_c$), expansion ($V_E$) chambers is linked to a pneumatic resonator and a section ratio $(a_C/a_E) \geqq 0.35$ is created between the two working faces of said piston so that the displacement of said piston along an axis X oriented toward the expansion volume ($V_E$) produces a pressure component $p_X$ of said working gas opposed in phase to said displacement of said piston with a view to inducing a pressure wave in said pneumatic resonator able to transport energy of said working volume to this resonator so as to compensate for its losses and create in said working volume an amplified pressure variation out of phase with respect to said pressure component $p_X$, in such a way as to transmit between this piston and said moveable member all of said mechanical energy produced.

2. The method as claimed in claim 1, wherein to transmit said mechanical energy from said transfer piston to said moveable induction member of an electric generator, the ratio $(a_C/a_E)$ created between the section $(a_C)$ of that working face of said transfer piston which is associated with said compression volume ($V_c$) and the section $(a_E)$ of that working face of this transfer piston which is associated with said expansion volume ($V_E$) lies between 40 and 60%.

3. The method as claimed in claim 1, wherein an end of said piston is made to exit said cylinder in a leaktight manner so as to place said end in communication with a closed volume in which said electric generator is disposed and said elastic restoring force is exerted with the aid of the pressure variations of the working gas contained in said closed volume, consecutively upon the displacement of said piston.

4. The method as claimed in claim 1, wherein to avoid the formation of steep-fronted waves, the section of a tubular duct intended to form said pneumatic resonator is varied.

5. The method as claimed in claim 4, wherein a Helmholtz volume is disposed at the opposite end of said tubular duct from that which is linked to one of said compression ($V_c$), expansion ($V_E$) chambers of said Stirling machine.

6. The method as claimed in claim 5, wherein a part of the tubular duct with variable section is disposed inside the Helmholtz volume.

7. The method as claimed in claim 6, wherein the working gas contained in said Helmholtz volume is cooled, respectively heated, in a controlled manner.

8. The method as claimed in claim 1, wherein the natural frequency of said resonator is adjusted by forming said working gas by mixing gases of various molecular masses in a specified proportion.

9. The method as claimed in claim 1, wherein to transmit said mechanical energy of said moveable member of an electric motor to of said transfer piston which is associated with the expansion chamber ($V_E$) is dimensioned smaller than the section ($a_c$) of that end of this transfer piston which is associated with the compression chamber ($V_c$).

10. A device for implementing the method as claimed in claim 1, wherein said piston is kinematically secured to said moveable induction member.

11. The device as claimed in claim 10, wherein said elastic restoring force exerted on said piston is produced by a closed space containing gas of a specified volume determined as a function of the desired natural frequency of said piston and one of the walls of which consists of a face of said piston whose surface area corresponds to the difference in area between said working surfaces.

12. The device as claimed in claim 1, wherein said movable member is a rotary member, linked to said piston by a connecting-rod assembly, linear means of guidance being associated with said piston.

13. The device as claimed in claim 1, wherein said resonator consists of two identical tubular elements ($T_1$, $T_2$) disposed in diametral opposition with respect to said transfer piston.

14. The device as claimed in claim 1, wherein said tubular resonator is linked to the expansion chamber ($V_E$) of the Stirling machine and that it is associated with heating means constituting the hot source of said Stirling machine.

15. The device as claimed in claim 14, wherein four Stirling devices are linked together by means of four tubular resonators ($T_1$–$T_4$), the transfer pistons of two nonadjacent Stirling devices working in phase and the other two in phase opposition.

16. The device as claimed in claim 14, wherein each end of the tubular resonator is linked to one of the cold ($V_c$), hot ($V_E$) chambers of a Stirling machine.

17. The device as claimed in claim 1, wherein said heating means exhibit the form of a solar radiation collector.

* * * * *